US008864109B2

(12) United States Patent
Cochrane

(10) Patent No.: US 8,864,109 B2
(45) Date of Patent: Oct. 21, 2014

(54) FENCE PANEL

(75) Inventor: Ian Dundonld Cochrane, Harare (ZW)

(73) Assignee: Birmingham Barbed Tape Ltd. (GB)

( * ) Notice: Subject to any disclaimer, the term of this patent is extended or adjusted under 35 U.S.C. 154(b) by 33 days.

(21) Appl. No.: 13/066,688

(22) Filed: Apr. 21, 2011

(65) Prior Publication Data

US 2011/0260128 A1 Oct. 27, 2011

(30) Foreign Application Priority Data

Apr. 23, 2010 (GB) ..... 1006791.6

(51) Int. Cl.
*E04H 17/16* (2006.01)
*E04H 17/04* (2006.01)

(52) U.S. Cl.
CPC ..... *E04H 17/04* (2013.01); *E04H 17/16* (2013.01)
USPC ..... 256/24; 256/32; 256/34; 256/73

(58) Field of Classification Search
USPC ..... 256/2–10, 19, 32–34, 24, 73
See application file for complete search history.

(56) References Cited

U.S. PATENT DOCUMENTS

| | | | | |
|---|---|---|---|---|
| 5,421,557 | A * | 6/1995 | Vise | 256/24 |
| 5,556,080 | A * | 9/1996 | Vise | 256/24 |
| 7,044,447 | B2 * | 5/2006 | Cano et al. | 256/5 |
| 2005/0072966 | A1 * | 4/2005 | Bergh et al. | 256/19 |
| 2007/0138454 | A1 * | 6/2007 | Yeo | 256/2 |
| 2007/0194293 | A1 * | 8/2007 | Edens et al. | 256/19 |
| 2011/0062402 | A1 * | 3/2011 | Neusch | 256/13.1 |

* cited by examiner

*Primary Examiner* — Victor MacArthur
(74) *Attorney, Agent, or Firm* — Ira S. Dorman

(57) ABSTRACT

A fence panel includes a sheet (12, 52) of mesh material with a first side (16) and an opposed second side (20) and, secured at least to the first side, a plurality of elongate reinforcing members (14, 18). The elongate reinforcing members (14, 18) are spaced from one another and are made from or include a material which has a hardness which is greater than the hardness of the material from which the sheet (12) is made.

9 Claims, 2 Drawing Sheets

FENCE PANEL

BACKGROUND OF THE INVENTION

This invention relates to a panel for use in the erection of a high security fence.

As used herein the word "fence" includes a barrier which is used to demarcate one area from another, typically for protection and security purposes.

A fence of the aforementioned kind should be physically strong and robust. These attributes make it difficult for an intruder to penetrate the fence.

Sheet material which embodies a high density mesh structure has been used with success in security fencing. The mesh material is made from closely spaced metallic rods. The close spacing makes it difficult for an intruder to cut the rods and provides very little in the way of a foot hold which could facilitate scaling of the fence by an intruder. In addition the mesh material does not unduly impede vision which means that, from an aesthetic point of view, the fence is generally more acceptable.

Despite the aforementioned positive features the fence can be penetrated, fairly easily, by an intruder who has access to equipment such as an angle grinder. The rods in the fence can be cut fairly quickly and, in this way, a hole can be opened through which an intruder can climb.

An object of the present invention is to provide a fence panel which offers greater resistance to an intruder.

SUMMARY OF THE INVENTION

The invention provides a fence panel which includes a sheet of mesh material with a first side and an opposed second side and, secured at least to the first side, a plurality of elongate reinforcing members which are spaced from one another and which are made from or include a material which has a hardness which is greater than the hardness of the material from which the sheet is made.

"Hardness" as used herein signifies a resistance of the material in question to an attack, for example by using a mechanical device such as an angle grinder, saw or chisel. "Hardness" in this context thus denotes the resistance of the material to cutting, indentation, grinding or abrasion, typically as measured by Brinell, Rockwell, Vickers or similar hardness tests. In addition "hardness" relates to the capability of the material to withstand, to a considerable extent, the effects of flames at high temperatures produced, for example, by an oxy-acetylene torch or the like. To achieve these diverse characteristics the material may be of a composite nature, as is described hereinafter.

Reinforcing members may also be adhered to the second side of the mesh sheet.

In one form of the invention each elongate member comprises a respective length of hard steel similar to armour plating.

The reinforcing members are extremely difficult to penetrate or break. Thus to ensure an optimum deterrent effect the spacing between pairs of adjacent members, in a horizontal direction, and in a vertical direction, should be such that even if the mesh material is cut, and removed, the resulting gap or gaps in the panel are so small that an assailant would not easily be able to pass through a gap.

In one form of the invention the desired hardness level of the reinforcing element is obtained by using a ceramic or similar material. For example use is made of alumina (aluminium oxide) or a carbide. The high hardness material can be encased inside a tubular enclosure. The high hardness material can be prepared in fluent form and injected into an interior of a tubular enclosure and then allowed to set. Alternatively the high hardness material can be preformed into a desirable shape and inserted, in one or more sections, into an interior of a tubular enclosure.

An effective preparation comprises a fluent cementitious mix, typically inclusive of a cement or concrete hardener, with particulate inserts made from hard or ultra-hard rocks, steel, glass, silica, composite materials or the like which, in themselves, are difficult to cut or penetrate. The cement then forms a bonding paste and, in fluent form, facilitates placement of the mixture in the interior of the tubular enclosure.

Ultra hard rocks or carbide compositions are extremely difficult to cut with a saw or even an angle grinder. In addition this type of material can withstand to a considerable degree the effects of high temperature attack for example when use is made of an oxy-acetylene torch or the like. These materials are often brittle and for this reason are not normally used in isolation. A further factor to be taken into account is the difficulty of shaping an ultra hard material into a form which lends itself for use in the construction of a fence panel. This objective can however be met, to a substantial extent, by placing the ultra hard material, which is resistant to physical and flame attack, in the tubular enclosure which helps to shape the fluent material and which thereafter, outwardly, has the same appearance as an enclosure which is devoid of ultra hard material.

The tubular enclosure may be made of a suitable steel or the like.

Thus in one embodiment the fence panel includes a sheet of mesh material with opposed first and second sides and, adhered at least to the first side, for example by means of welding, a plurality of elongate reinforcing members which are spaced apart from one another, wherein each reinforcing member includes an elongate tubular housing and, within the housing, an element which is made from a material which has a hardness substantially greater than the hardness of the mesh material.

The mesh sheet material may be a high density mesh with vertically-extending rods which are spaced apart by a first distance, and horizontally-extending rods, secured to the vertical rods, which are spaced apart, in a vertical sense, by a distance which is substantially less than the spacing between adjacent vertically-extending rods.

In a variation of the invention the mesh sheet material is formed from razor wire or a similar deterrent component and the reinforcing members, of the aforementioned kind, are applied to one or both sides of the razor wire mesh material.

BRIEF DESCRIPTION OF THE DRAWINGS

The invention is further described by way of examples with reference to the accompanying drawings in which.

DESCRIPTION OF PREFERRED EMBODIMENTS

Figure 1:
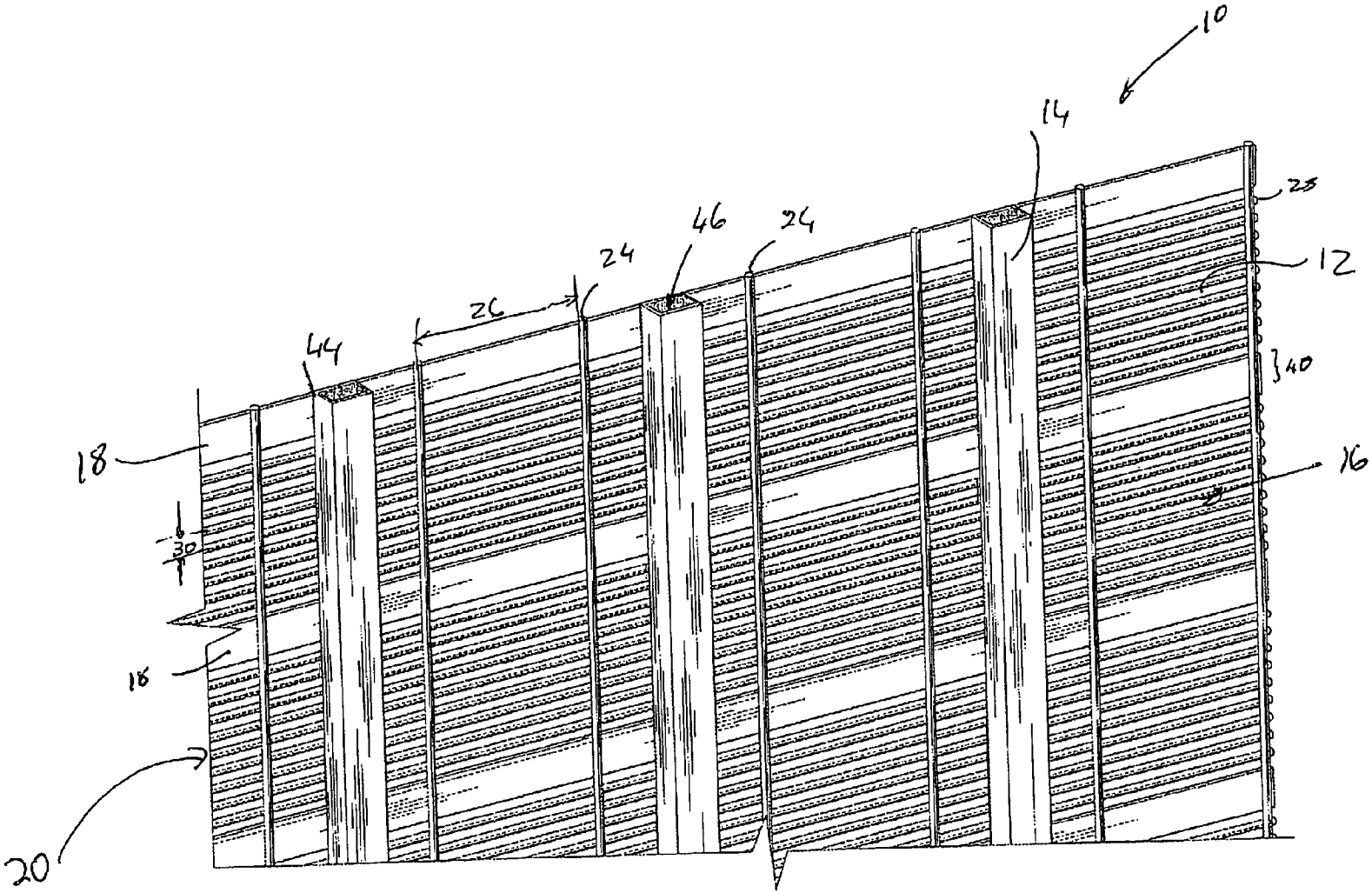
FIG. 1 is a perspective view of a portion of a fence panel according to one form of the invention.

FIG. 1 of the accompanying drawings illustrates, in perspective, a portion of a fence panel 10.

The fence panel includes a sheet 12 of a high density mesh formed with rectangular apertures, a plurality of elongate reinforcing members 14 on a first side 16 of the sheet 12 and a plurality of elongate reinforcing members 18 on an opposed side 20 of the sheet 12.

The sheet 12 includes elongate vertically-extending steel rods 24 which are spaced apart from one another by a distance 26, and horizontally-extending rods 28 which are spaced apart from one another by a distance 30 which is substantially less than the distance 26. The vertical rods 24 and the horizontal rods 28 are precisely positioned relatively to each other in overlapping arrays and are welded to each other, using resistance welding techniques which are known in the art, to form a firm mesh structure.

On the second side 20, at regular intervals, two or three of the rods 28 are omitted to form a gap 40. A respective reinforcing member 18 is positioned in the gap and is welded at points of contact to the various vertically-extending rods 24.

The reinforcing members 18 can be lengths of flat bar, made from mild steel or a steel which has the same hardness as the rods 24 and 28.

Each reinforcing member 14 is formed from rectangular or square tubing 44, of suitable dimensions, which is made from material with a hardness which may be the same as the hardness of the reinforcing members 18. The tubing forms a housing for an insert 46. The insert can be preformed in one or more segments or sections which are sized to fit relatively easily inside the tubular housing. The segments can be bonded to an internal surface of the tubular housing, if required, by making use of a suitable adhesive which has a resin. In an alternative approach the insert is initially in fluent form, formed from an appropriate mixture of materials, and the fluent mixture is poured or injected into the interior of each tube so that it completely fills the tube and, upon setting, solidifies into a hard mass.

The insert 46 is made from a ceramic or similar material. For example alumina can be mixed with a cementitious paste which, optionally, contains an appropriate cement hardener. A fluent mixture is prepared with a suitable viscosity which allows the mixture to be placed inside the interior of a tube.

The members 44 are positioned at regular intervals on the first side of the sheet 12. Each member is between two adjacent vertical rods 24. The members 44 can be welded to the various horizontally-extending rods 28 at points of contact and, additionally, to the horizontally-extending reinforcing members 18.

The placing of the insert 46 into each tube 44 can be done before or after the tube is welded to the mesh sheet material.

In a variation of the fence panel 10 the horizontally-extending reinforcing members 18 are made in the same way as the vertically-extending reinforcing members 14.

Figure 3:
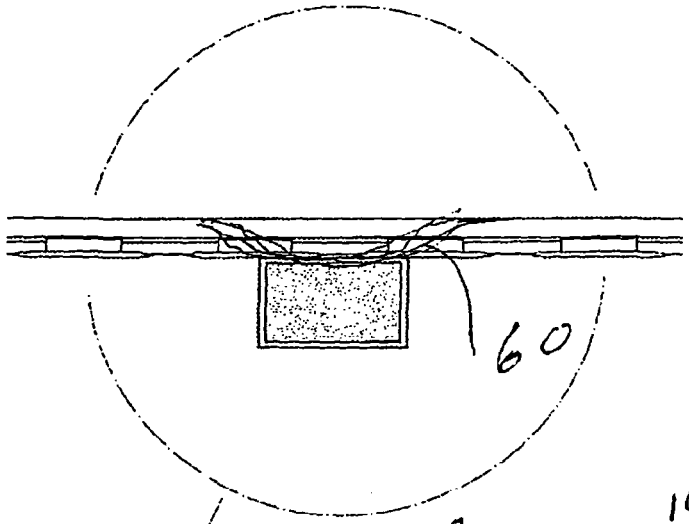
FIG. 3 is a view in cross-section, on an enlarged scale, of part of the fence panel shown in FIG. 2.
Figure 2:
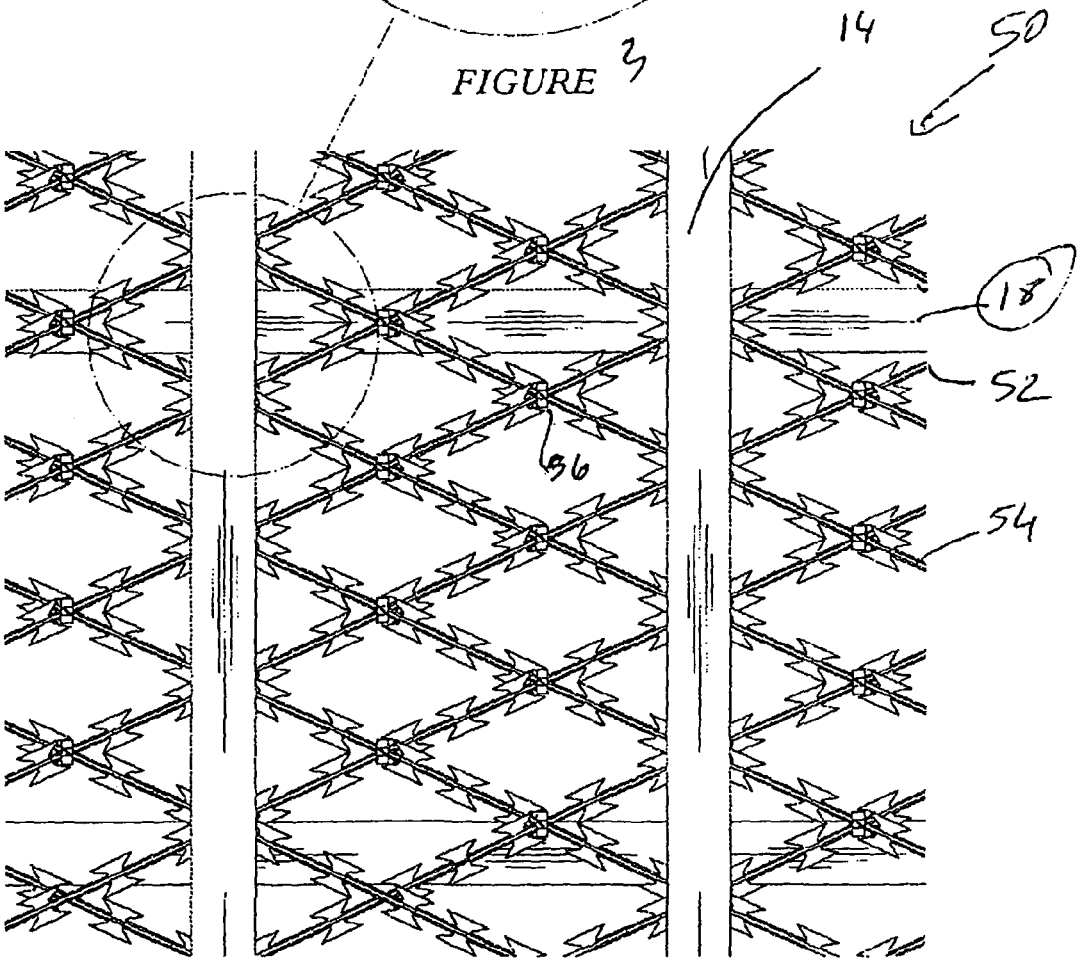
FIG. 2 is a side view of a portion of a fence panel according to a second form of the invention.

FIG. 2 is a side view of a fence panel 50 which is constructed in accordance with the aforementioned principles while FIG. 3 is a cross-sectional view on an enlarged scale of part of the fence panel 50.

Use is made of a sheet 52 of mesh material which is formed from elongate lengths 54 of razor wire which are arranged in two overlapping arrays to form a diamond configuration. The lengths 54 are secured to each other, at points of contact, using stout steel clips 56. Alternatively the lengths can be welded to each other at the points of contact and the clips 56 can be dispensed with.

The sheet 52, on one side, has horizontally-extending reinforcing members 18 of flat bar, which are similar to those described in connection with FIG. 1. Vertically-extending reinforcing members 14, similar to those described in connection with FIG. 1, are fixed to an opposing side of the sheet. The two sets of reinforcing members are welded to each other at locations at which they intersect. This process can be facilitated by forming the horizontally-extending lengths of flat bar 18 with indentations 60, as is shown in FIG. 3, so that there is direct metal-to-metal contact between the members 18 and the members 14. With this approach it is necessary to position the members 14 and 18 at appropriate locations so that direct contact between the members 14 and 18 can be achieved.

The use of the high hardness material holds a significant security benefit. The ceramic-type material, for example, is difficult to cut even if use is made of a powered tool such as an angle grinder. Specialized equipment is called for in order to breach this type of structure. Although it may be possible for an intruder to cut through the mesh sheet, with relative ease, if the ceramic reinforcing members are fairly close to one another, it is not easy for an intruder to make a big enough opening for human passage. The fence panel does not unduly impede visibility and thus, particularly for the FIG. 1 embodiment, is generally aesthetically acceptable. The benefits which are associated with the use of high density mesh sheeting are not however diminished.

In a variation of the invention the members 14 are replaced with lengths of armoured steel plate, in the form of flat bar. This material is also extremely difficult to cut with a mechanical tool such as a saw or an angle grinder.

The invention claimed is:

1. A fence panel which includes a sheet of mesh material with a first side and an opposed second side, the mesh material comprising elongate, vertically extending steel rods which are spaced apart from one another in a horizontal direction by a first distance, and horizontally extending steel rods which are spaced from one another by a second distance which is less than the first distance, the vertical rods being welded to the horizontal rods, a plurality of horizontally extending lengths of flat steel bar located on the second side, each flat bar being positioned between an adjacent pair of horizontally extending rods, a plurality of vertically extending tubular steel members located on the first side, which are spaced from one another, each tubular member being positioned between a respective adjacent pair of vertically extending rods, the tubular members overlying and being welded to the horizontally extending flat bars at points of contact; and each tubular member being filled with a cementitious mix which contains particulate inserts selected from the group consisting of hard or ultra-hard rocks, steel elements, glass elements, silica elements, alumina elements, and carbide elements, the cementitious mix providing a core element for each tubular member.

2. A fence panel as claimed in claim 1, wherein the spacing between pairs of adjacent steel rods, in both a horizontal direction and a vertical direction is such that, even if the mesh material were cut and removed, the resulting gap or gaps in the panel would be so small that an assailant would not be able to pass through a gap.

3. A fence panel as claimed in claim 1, wherein the core material is a formed-in-place core material consisting of the cementitious mix.

4. A fence panel as claimed in claim 3, wherein the cementitious mix is composed as a bonding paste.

5. A fence panel as claimed in claim 1, wherein the core material comprises at least one preformed section of the cementitious mix.

6. A fence panel as claimed in claim 1, wherein the cementitious mix includes a cement or concrete hardener.

7. A fence panel as claimed in claim 1, further including elongate reinforcing members adhered to the second side of the mesh sheet.

8. A fence panel as claimed in claim 1, wherein the mesh sheet material is formed from razor wire.

9. A fence panel as claimed in claim 8, further including elongate reinforcing members adhered to the second side of the mesh sheet.

* * * * *